US005529058A

United States Patent [19]

Crippen

[11] Patent Number: 5,529,058

[45] Date of Patent: Jun. 25, 1996

[54] PERSONAL SELF-CONTAINED AIR SAFETY SYSTEM

[76] Inventor: Warren S. Crippen, 84 Lincoln Ave., Winchendon, Mass. 01475

[21] Appl. No.: 315,883

[22] Filed: Sep. 30, 1994

[51] Int. Cl.[6] ..... A62B 18/10; A62B 18/00; A62B 17/04; A62B 9/02

[52] U.S. Cl. ..... 128/201.28; 128/205.21; 128/201.23; 128/205.25

[58] Field of Search ..... 128/201.22–201.25, 128/205.21, 205.22, 205.25

[56] References Cited

U.S. PATENT DOCUMENTS

| | | | |
|---|---|---|---|
| 2,850,011 | 9/1958 | Schaefer | 128/201.28 |
| 3,762,407 | 10/1973 | Shonerd | 128/205.21 |
| 3,976,063 | 8/1976 | Henneman et al. | 128/205.21 |
| 4,116,237 | 9/1978 | Birch | 128/201.28 |
| 4,221,216 | 9/1980 | Kranz | 128/201.28 |
| 4,233,970 | 11/1980 | Kranz | 128/201.28 |
| 4,452,240 | 6/1984 | Moretti | 128/201.28 |
| 4,508,115 | 4/1985 | Warncke | 128/201.28 |
| 4,766,893 | 8/1988 | Drews | 128/201.23 |
| 4,807,614 | 2/1989 | Van Der Smissen et al. | 128/201.28 |
| 4,815,893 | 3/1989 | Feder | 128/202.15 |
| 5,027,810 | 6/1991 | Patureau et al. | 128/206.24 |
| 5,115,804 | 5/1992 | Brookman | 128/201.25 |

FOREIGN PATENT DOCUMENTS

| | | | |
|---|---|---|---|
| 2203652 | 10/1988 | United Kingdom | 128/206.12 |
| 0325959 | 8/1989 | United Kingdom | 128/201.23 |

*Primary Examiner*—Edgar S. Burr
*Assistant Examiner*—Daniel J. Colilla
*Attorney, Agent, or Firm*—Walter G. Finch; Nancy A. Smith

[57] ABSTRACT

This invention, consisting of a mask and an air delivery system, provides the individual user an increased level of protection and additional time to evacuate in the case of an emergency situation where the normal environment has been contaminated (i.e. by fire, chemical spill, etc.). The invention provides the evacuating person with a small amount of portable compressed air (approximately a 10 minute supply) for breathing from a small pressurized canister that resembles an aerosol canister. The air is delivered at a pre-set pressure and flow rate through a self-contained regulating system, to a mask through a plastic air supply tube. In addition, the invention also provides the user with protection for the face and eyes by virtue of a clear plastic hood which is attached to the mask. The invention is designed to be inexpensive, light weight and disposable/recyclable and is a single use apparatus.

1 Claim, 1 Drawing Sheet

PERSONAL SELF-CONTAINED AIR SAFETY SYSTEM

BACKGROUND OF THE INVENTION

This invention relates to a breathing apparatus, and more particularly to the prevention of the inhalation of smoke, chemical fumes and other noxious vapors during evacuation in times of emergency. This invention relates to U.S. patent application Ser. No. 07/877,080, filed May 1, 1992.

SCOPE OF INHALATION SYSTEM

The purpose of this invention is to provide a viable self-contained system that will afford the user protection from smoke inhalation, chemical fume inhalation and the inhalation of other noxious vapor(s) during an evacuation in times of emergency. In addition, the system would provide the user with some protection to the eyes in a compromised environment.

THE PRIOR ART (Background Matter)

To the extent of research possible, it has been determined that at this time there is no other single reference showing a configuration of materials available which combines all of the features of the present invention. However there are several references which show some features which are related to those herein described.

| | | |
|---|---|---|
| 4,766,893 | Drews | August, 1988 |
| GB 2,203,652 | Gil-Rodrguez | October, 1988 |
| EP 0,325,959 A2 | Scott | August, 1988 |
| 5,115,804 | Brookman | May, 1992 |
| 4,815,893 | Feder | March, 1989 |

None of these references when taken singly or in combination teach the invention as claimed in the application.

SUMMARY OF THE INVENTION

This system provides the individual user with an increased level of protection, and additional time to evacuate, in the case of an emergency situation where the normal environment has been contaminated (i.e. fire, chemical spill, etc.). The system is designed to be inexpensive, lightweight, disposable and recyclable. It is a single use apparatus.

The system provides the user with a small amount of portable compressed air (approximately a 10 minute supply) for breathing from a small pressurized canister that resembles an aerosol can. The air is delivered at a preset pressure and flow rate through a self-contained regulating system, to a mask through a plastic air supply tube. The mask is designed to cover the nose and mouth of the user.

The pressure and flow rate to the mask are determined and regulated using a regulating orifice or a series thereof. The size of the orifice(s) determines the pressure and flow rate delivered. The orifice size is preset during manufacture. In addition, the system also provides the user with protection for the face and eyes of the user by virtue of a clear plastic hood which is attached to the mask. The hood is meant to completely cover the head of the user.

OBJECTS OF THE INVENTION

It is an object of the invention to provide an individual user with an increased level of protection and additional time to evacuate in case of an emergency situation when the normal environment has been contaminated (i.e. fire, chemical spill, etc.).

Another object of this invention is to provide a personal self-contained air safety system which is inexpensive, light weight and disposable/recyclable.

Still another object of this invention is to provide a personal self-contained air safety system which is a single use apparatus.

And yet another object of the invention is to provide a user with a small amount of portable compressed air (approximately 10 minutes supply) for breathing contained in a small pressurized canister that resembles an aerosol canister.

BRIEF DESCRIPTION OF THE DRAWINGS

These objects and other attendant advantages of this invention will become more obvious from the following accompanying drawings and detailed description wherein.

DETAILED DESCRIPTION OF THE DRAWINGS

Figure 1:
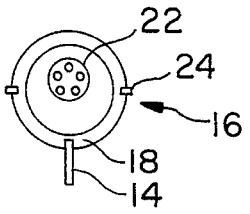
FIG. 1 shows the front of a mask of a personal self-contained air safety system.
Figure 2:
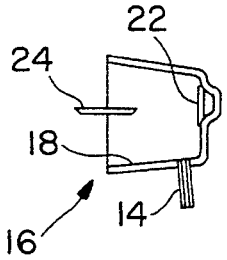
FIG. 2 shows the side details of the mask of FIG. 1.
Figure 3:
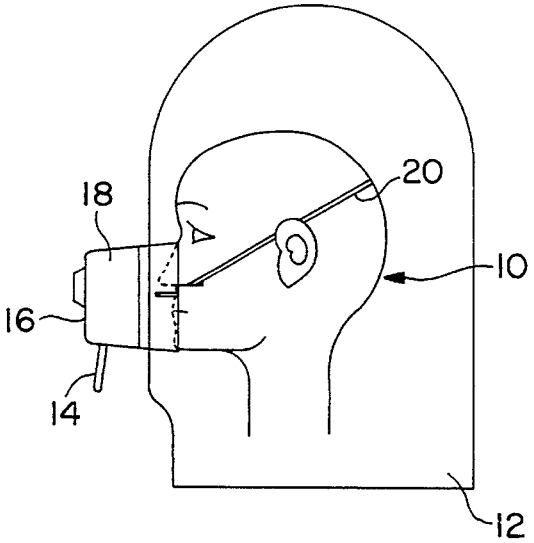
FIG. 3 is a side view of the mask of FIG. 1 with a hood.
Figure 4:
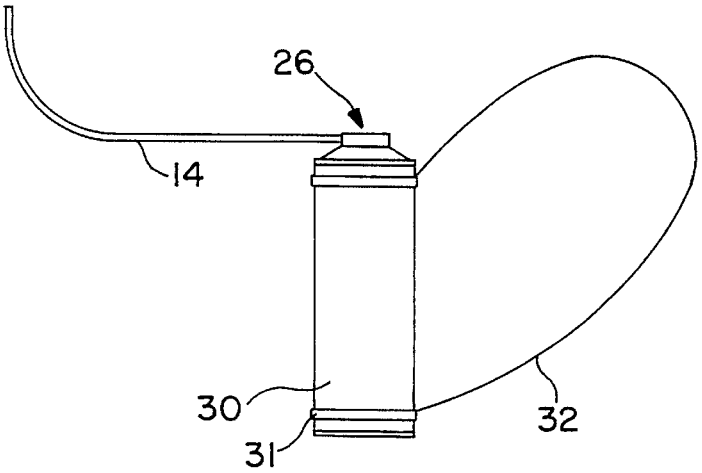
FIG. 4 is a schematic delivery system.
Figure 5:
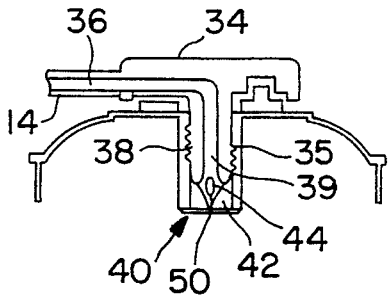
FIG. 5 is a schematic of an actuator valve and regulator assembly.

The personal contained air safety system represented in Figs. 1–5 is comprised of the following two major components, a mask 16, shown in FIG. 1–3, and an air delivery system, shown in FIGS. 4 and 5.

The mask 16 is made up of a plastic cup 18 that fits over the nose and mouth of the user 10 (similar in design to the oxygen masks used in airplane emergency oxygen supply systems).

The mask 16 is fitted with an elastic head strap 20 that attaches to the mask 16 through openings 24 at the sides of the cup 18 and holds the mask 16 in place over the nose and mouth of the user 10 during use. A clear plastic hood 12 covers the head of the user 10. The hood 12 is attached to the plastic cup 18 and the elastic strap 20 fits under the hood 12. The hood 12 should be completely clear so as to prevent any obstruction of the user's 10 view while using the air safety system.

In the plastic cup 18 has a one-way exhalation valve 22 to allow for the exhalation of carbon dioxide and prevent inhalation of toxic fumes while the system is in use. There is also an air supply tube 14 which goes into the plastic cup 18.

The air delivery system consists of several sub-components, namely the air canister 30, the carrying strap 32, and the actuation valve and pressure regulator assembly 26.

The air canister 30 is a small pressurized container of portable compressed air. Generally the canister 30 should be large enough to hold approximately a 10 minute supply of oxygen for the user. The actuation valve and pressure regulator assembly 26 are attached to the top of the canister 30.

The outlet hose barb 36 connected to the actuation valve and pressure regulator assembly 26 attaches to the air supply tube 14 at a slightly positive pressure to insure a consistent supply of air to the user and to help maintain the integrity of the system in a compromised environment. The actuation valve 26 is designed with a lock-on feature that prevents the valve from being shut off once it is activated.

The size of the air canister 30 is consistent with the volume requirements for containing a compressed amount of air that is capable of supplying the user with approximately 10 minutes of breathable air. The canister 30 is similar in design and manufacture to an aerosol canister used for spray can applications and is to be disposable and recyclable.

The carrying strap 32 is a simple plastic or woven cloth strap that is attached to the air canister 30 through molded plastic bands 31 that surround the canister 30. The strap is designed to aid the user in carrying the canister 30 and would normally be placed over the shoulder of the user to keep the user's hands free during an emergency.

The actuation valve and regulator assembly 26 is designed to be easy to use and fail-safe. It has a knob 34 with a lock-on device 35. Attached to the knob 34 is a plunger device 38 and the outlet hose barb 36. The knob 34 and valve plunger 38 fit into a cavity 42 built into the top of the air canister 30. This cavity 42 and plunger 38 are fitted with threads 35 to allow the knob 34 to turn the plunger 38 down into the cavity 42. The plunger 38 is designed in such a way as to provide both the means for actuating the valve and providing an outlet for the air.

The bottom of the plunger 38 is equipped with a pointed pronged tip 50. This tip 50 is sharp and the pronged effect provides channels for the air to flow through once the system has been activated. Internal to the plunger 38 is a series of small orifices 44 that are designed to regulate both the pressure and the flow of the air through the system.

The size of the orifices 44 is the determining factor in the air pressure and flow regulation. At the bottom of the cavity 42 and covering the top of the air canister 30 is a thin metal valve seal 40. When the knob 34 is turned, the sharp tip 50 of the plunger 38 pierces the seal 40 allowing the compressed air in the canister 30 to escape and pass through the regulating orifices 44. The air flows through said orifices 44 into a channel 39 within the knob/plunger assembly and out the outlet hose barb 36. The air is then conveyed to the mask 16 through the plastic air supply tube 14.

The carrying strap 32 is provided for carrying the personal contained air safety system when in use.

It can be readily understood from the foregoing description of the invention that the present structure can be configured in different modes without departing from the scope and intent of the appended claims.

What is claimed is:

1. A personal self-contained air safety system to be used as a breathing apparatus for a person during an evacuation of an area characterized by smoke, chemical fumes, and other noxious vapors, comprising:

a mask formed of a plastic cup which attaches to the face over the nose and the mouth of the head of an evacuating person;

a one-way exhalation valve means formed in said plastic cup for removing exhaled air;

an elastic strap attached to said plastic cup for securing said mask over the face of said evacuating person;

a clear plastic hood attached to said plastic cup which covers the head, face and eyes of said evacuating person;

a pressurized air canister containing a specific amount of breathable, compressed air and having a top covered with a thin sheet of metal;

a carrying strap means attached to said pressurized air canister for hands free carrying of said canister during said evacuation;

an actuation valve means with a pronged, pointed object having a multiplicity of orifices, whereby said pointed object pierces said thin sheet of metal and releases said specific amount of breathable compressed air from said canister and through said orifices;

an outlet hose barb attached to said actuation valve means;

an air hose attached to said outlet hose barb and also connected to said mask for delivering said breathable compressed air from said canister to said mask of said air safety system;

a pressure regulator means for regulating the flow of said specific amount of said breathable compressed air from said canister to said mask, having said multiplicity of orifices arranged into said pointed object through which a steady stream of said compressed breathable air flows;

a threaded turning knob means for activating said actuation valve means and for forcing said pointed, pronged object through said thin sheet of metal; and a locking means for making said actuation valve irreversible, wherein said air safety system is designed for a single, short term use.

* * * * *